United States Patent [19]

Masica et al.

[11] Patent Number: 4,758,333

[45] Date of Patent: Jul. 19, 1988

[54] SIEVE

[75] Inventors: Gregory M. Masica; Eric J. Straub, both of Mt. Vernon, Ind.

[73] Assignee: General Electric Company, Mt. Vernon, Ind.

[21] Appl. No.: 29,023

[22] Filed: Mar. 23, 1987

[51] Int. Cl.[4] ..... B07B 1/49

[52] U.S. Cl. ..... 209/397

[58] Field of Search ..... 209/392, 397, 341

[56] References Cited

U.S. PATENT DOCUMENTS

| | | | |
|---|---|---|---|
| 434,247 | 8/1890 | Closz | 209/397 |
| 807,355 | 12/1905 | Campbell | 209/397 |
| 2,311,813 | 2/1943 | Beck et al. | 209/397 |
| 2,827,169 | 3/1958 | Cusi | 209/397 |
| 4,062,768 | 12/1977 | Elliot | 209/341 |

FOREIGN PATENT DOCUMENTS

| | | | |
|---|---|---|---|
| 812740 | 9/1951 | Fed. Rep. of Germany | 209/397 |

*Primary Examiner*—Sherman D. Basinger
*Assistant Examiner*—Jesûs D. Sotelo
*Attorney, Agent, or Firm*—Joseph T. Eisele; Martin B. Barancik

[57] ABSTRACT

A sieve is found useful for the separation of solid particles having substantially equal length and width dimensions from elongate shaped particles, comprising a corrugated sheet having sieve openings on the pitch between ridges and furrows of the corrugations and imperforate furrow bottoms.

5 Claims, 1 Drawing Sheet

SIEVE

BACKGROUND OF THE INVENTION

1. Field of the Invention

The invention relates to sieves for use with vibratory and gyratory equipment to separate off-sized material in sizing applications.

1. Brief Description of the Prior Art

Sieves and sieving apparatus have been employed for countless centuries to separate materials such as mixtures of particles having different sizes or shapes. The present invention is of an improved sieve design which separates with greater efficiency, in particular, mixtures of particle solids of substantially equal length and width dimensions from elongate particles.

SUMMARY OF THE INVENTION

The invention comprises a sieve, which comprises;

a corrugated sheet having an upper surface, a lower surface and a peripheral edge defining the outer perimeter of the sheet and located between upper and lower surfaces;

said corrugated sheet having a plurality of alternating, parallel peaked ridges and furrows;

the peaks of the ridges and the base of said furrows being joined by pitched areas of said sheet;

the pitched areas being perforated with a plurality of sieve openings adjacent to the ridge peaks;

the pitched areas having a zone below the perforations and adjacent to the base of said furrows which is imperforate;

the imperforate areas being of a dimension and configuration to receive elongate particles.

The sieve of the invention may be used as the sieve component of a vibratory or a gyrating sieving apparatus for the separation of solid materials, particularly uniformly dimensioned (in length and width) particles from elongate particles.

DETAILED DESCRIPTION OF THE PREFERRED EMBODIMENTS OF THE INVENTION

Figure 2:
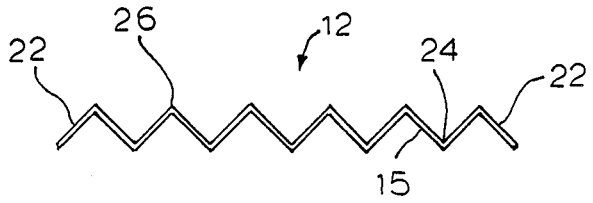
FIG. 2 is a side elevation of a portion of the bed of the sieve shown in FIG. 1.
Figure 3:
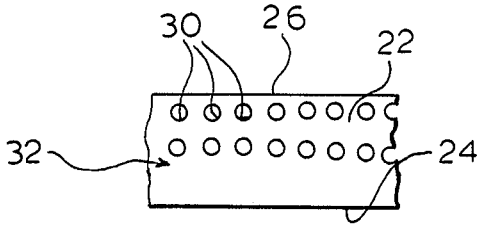
FIG. 3 is an enlarged view of a portion of the pitched portion of the sieve bed shown in FIG. 1.
Figure 1:
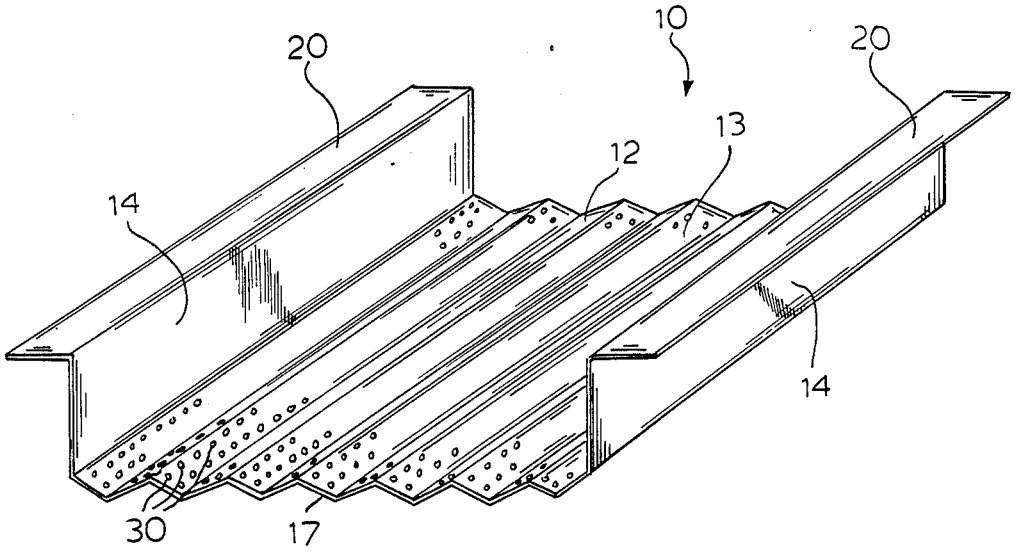
FIG. 1 is a view-in-perspective of an embodiment sieve of the invention.

Those skilled in the art will gain an appreciation of the invention from the following description of the preferred embodiments when read in conjunction with a viewing of the accompanying drawings of FIGS. 1–3, inclusive.

Referring first to FIG. 1, there is seen a view in perspective of an embodiment sieve 10 of the invention. The sieve 10 comprises a deck 12 which is a sheet of corrugated material, having an upper surface 13 and a lower surface 15 (not seen in FIG. 1) all of which are bounded by a peripheral edge 17 defining the outer perimeter of the sheet, between upper and lower surfaces 13, 15. The corrugated sheet comprising deck 12 has on two opposing edges 17 of the deck 12, upwardly projecting flanges 14 as a means for attachment to a sieve carrier apparatus. Positioned on the upper aspect of the flanges 14 is a seating lip 20 as a means of securing the sieve to a sieve carrier apparatus, for example apparatus as described in the U.S. Pat. No. 4,062,768 .

The embodiment sieve 10 of the invention may be fabricated from any rigid or semi-rigid material having the structural integrity required of a sieve. Representative of such materials are metals, synthetic polymeric resins and the like. Preferably, the sieve 10 is fabricated from a sheet metal such as sheet iron.

FIG. 2 is an end view of a portion of the edge 17 inward of the upwardly projecting flanges 14. As shown in FIG. 2, the corrugated decking 12 has a plurality of alternating, parallel peaked ridges 26 and furrows 24. The peaks 26 and the pits or base of the furrows 24 are joined by a pitched area 22 of the deck 12. The area 22 adjacent to the peaks 26 are perforated with a plurality of round sieve openings 30 except for a zone 32 adjacent to the base of the furrow 24 (see FIG. 3, an enlarged view of the area 22). The pits of the furrows 24 are solid and do not bear any perforations.

The base or pits of each of the furrows 24 are of a size and configuration, suited to accept elongate particles which could pass through the sieve openings 30 if aligned so that their smallest dimension could so pass. The sieve openings 30 are of a size and dimension suitable for separation of solid particles (round, cylindrical, square) of any given size and may be selected for particular solid particles of known, substantially uniform (in height, length and width) dimension; but which will not pass the elongate particles when the latter are presented to the opening 30 along their long dimension.

The angle of the pitch shown in the corrugations of deck 12 are not critical. Advantageously, the degree of inclination (or declination) between the ridge peak 26 and the pit of furrow 24 is within the range of from about 30° to about 60°.

As will be appreciated from the above description, the sieve of the invention possesses a sieve deck or bed which resembles an accordion in shape. The sieve perforations are located on the sides of the hills or pitched areas. The furrows or valleys are solid (imperforate) and aligned in the same direction as material flow to allow elongate shapes or other off size material to collect and slide off the screen deck without being channelled to the apertures 30. This allows the elongate shapes to orient themselves in the furrows in the direction of material flow so that they do not turn upright and slide through the openings 30. Flow may be assisted by inclining the sieve 10 in the direction of the furrows 24. At the same time, solid particles of substantially uniform dimension are swept by vibratory or gyratory motion of the sieve carrier, and roll up the pitch of area 22 in response to the motion of the sieve screen. Being of a dimension which will pass through the openings 30 regardless of which dimension is presented, passage occurs. In contradistinction, the off size (elongate) material which cannot reach the openings 30 is discharged from the edge 18 of the screen, advantageously into a scrap container.

Advantageously, the sieve of the invention is mounted on a sieve carrier which operates by either vibratory or gyratory movements imparted to the sieve.

In a comparison with a sieve having a flat deck or bed, plastic pellets having substantially equal length and width dimensions of about 3 millimeters were separated from so-called "short- longs" having an elongate length approximately double that of the uniformly dimensioned particles. The sieve of the invention exhibited an increased efficiency of separation over the flat decked sieve (from 58% to 76%).

What is claimed is:

1. A sieve, which comprises;

a corrugated sheet having an upper surface, a lower surface and a peripheral edge defining the outer perimeter of the sheet and located between upper and lower surfaces;

said corrugated sheet having a plurality of alternating, parallel peaked ridges and furrows;

the peaks of the ridges and the base of said furrows being joined by a pitched area of said sheet; each pitched area being perforated with a plurality of sieve openings adjacent to the ridge peaks;

each pitched area having a zone below the perforations and adjacent to the base of said furrows which is imperforate;

the imperforate areas being of a dimension and configuration to receive elongate particles.

2. The sieve of claim 1 which further comprises means on the peripheral edge for mounting upon a sieve carrier.

3. The sieve of claim 2 wherein said means comprises an upwardly projecting flange.

4. The sieve of claim 1 wherein the pitch is at an angle of from 30° to 60° from the horizontal.

5. A method of separating solid particles of substantially uniform length and width from solid particles having an elongate shape, which comprises;

providing a sieve, which comprises;

a corrugated sheet having an upper surface, a lower surface and a peripheral edge defining the outer perimeter of the sheet and located between upper and lower surfaces;

said corrugated sheet having a plurality of alternating, parallel peaked ridges and furrows;

the peaks of the ridges and the base of said furrows being joined by a pitched area of said sheet;

the pitched area being perforated with a plurality of sieve openings adjacent to the ridge peaks;

the pitched areas having a zone below the perforations and adjacent to the base of said furrows which is imperforate;

the imperforate areas being of a dimension and configuration to receive elongate particles;

wherein the openings will sieve out the solid particles of substantially uniform dimension, but not the elongate particles when presented to the opening along the elongate dimension;

applying a mixture of solid particles of substantially uniform dimension with elongate shaped particles to the upper surface of the sieve;

causing the applied mixture to flow across the upper surface of the sieve, in the direction of the furrows; and applying motion to the sieve in a plane parallel to the sieve surfaces;

whereby separation of the mixture occurs.

* * * * *